United States Patent [19]

Sumigawa

[11] Patent Number: 4,552,511

[45] Date of Patent: Nov. 12, 1985

[54] PROPELLER FOR MARINE PROPULSION DEVICE

[75] Inventor: Yukio Sumigawa, Iwata, Japan

[73] Assignee: Sanshin Kogyo Kabushiki Kaisha, Japan

[21] Appl. No.: 555,469

[22] Filed: Nov. 28, 1983

[30] Foreign Application Priority Data

Nov. 30, 1982 [JP] Japan ..... 57-208526

[51] Int. Cl.[4] ..... B63H 1/26

[52] U.S. Cl. ..... 416/242; 416/237; 416/243

[58] Field of Search ..... 416/237, 242, 243, 223

[56] References Cited

U.S. PATENT DOCUMENTS

| | | | |
|---|---|---|---|
| 1,455,591 | 5/1923 | Lawson | 416/223 X |
| 1,981,392 | 11/1934 | Selman | 416/223 X |
| 2,283,956 | 5/1942 | Smith | 416/223 X |
| 2,426,617 | 9/1947 | Kell | 416/223 X |
| 3,077,173 | 2/1963 | Lang | 416/237 X |
| 3,514,215 | 5/1970 | Williams | 416/242 X |
| 3,697,193 | 10/1972 | Phillips | 416/242 X |
| 3,704,500 | 12/1972 | Okamoto | 416/237 X |
| 3,706,430 | 12/1972 | Kline et al. | 416/223 X |
| 3,946,688 | 3/1976 | Gornstein et al. | 416/223 X |
| 3,952,971 | 4/1976 | Whitcomb | 416/242 |
| 4,073,601 | 2/1978 | Kress | 416/242 |
| 4,202,655 | 5/1980 | Maloof | 416/237 |
| 4,413,796 | 11/1983 | Bousquet | 416/242 X |
| 4,498,646 | 2/1985 | Proksch et al. | 416/223 R X |

FOREIGN PATENT DOCUMENTS

| | | | |
|---|---|---|---|
| 2550003 | 5/1977 | Fed. Rep. of Germany | 416/223 X |
| 2314862 | 1/1977 | France | 416/237 |

*Primary Examiner*—Everette A. Powell, Jr.
*Attorney, Agent, or Firm*—Ernest A. Beutler

[57] ABSTRACT

An improved propeller blade configuration that permits a relatively strong configuration without reducing the cavitation thickness or efficiency of the blade. This is achieved by providing a planar section on the front face of the blade that merges into a recessed cup shaped portion and by having the rearwardmost axial portion of the rear face lie in an axial direction contiguous to the point of merger.

5 Claims, 3 Drawing Figures

PROPELLER FOR MARINE PROPULSION DEVICE

BACKGROUND OF THE INVENTION

This invention relates to a propeller for marine propulsion and more particularly to an improved, high strength, high efficiency propeller blade design.

As is well known, the function of a propeller in a marine propulsion unit is to drive the associated watercraft through the body of water in which it is operating. Normally, propellers for pleasure craft must be operated through a wide speed and load range and must have good efficiency throughout these running conditions. In order to prevent cavitation and to insure high efficiency, it has been has been the practice to provide a cup shaped depression in the trailing side of the forward face of the propeller blade. The rear or driving face of the blade is normally curved about an arc and the cup shaped depression on the front face prevents cavitation. However, in addition to providing good running efficiency, the propeller blade design should be such so as to insure high strength and long life. With the prior art type of constructions, this has necessitated the provision of a blade that is relatively wide in an axial direction. The use of such wide blades presents a number of disadvantages. In the first instance, the width of the blade causes an increase in resistance to turning and, accordingly, a loss of efficiency. Furthermore, as the width of the blade is increased, the likelihood of cavitation is still further increased.

It is, therefore, a principal object of this invention to provide an improved, high strength blade design for a marine propeller.

It is another object of this invention to provide a marine propeller blade design that insures good efficiency, high strength and resistance to cavitation and high efficiency.

SUMMARY OF THE INVENTION

This invention is adapted to be embodied in a marine propeller blade having a leading edge and a trailing edge with a forward face and a rearward face each extending from the leading edge to the trailing edge. The forward face has a generally planar part extending from contiguous to the leading edge toward the trailing edge and merging into a generally recessed portion extending toward the trailing edge. The blade has its greatest thickness in an axial direction in an area contiguous to the point of merger of the planar and recessed parts of the forward face.

PRIOR ART

Figure 1:
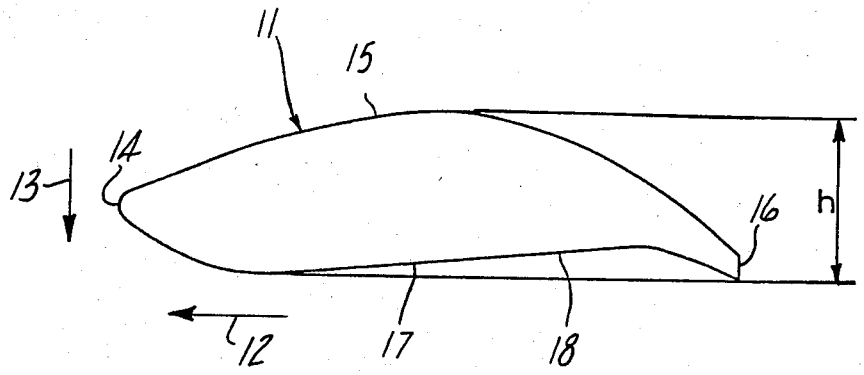
Fig-1 Prior Art
FIG. 1 is a development of the cross-sectional configuration of a propeller blade constructed in accordance with the prior art and taken along a radial plane.

FIG. 1 shows the cross-sectional development of a conventional propeller blade, indicated generally by the reference numeral 11, taken on a radial plane. The propeller blade 11 normally rotates in a direction indicated by the arrow 12 so as to drive an associated watercraft in an axial forward direction indicated by the arrow 13.

The blade 11 has a leading edge 14 from which a rearward, curved driving face 15 extends and which terminates at a trailing edge 16. A forward face 17 also extends from the leading edge 14 in spaced relationship to the rearward face 15 toward the trailing edge 16. In order to control the flow velocity over the rear face 15 and to prevent cavitation, a cup shaped recess 18 is formed in the forward face 17 adjacent the trailing edge 16.

In order to provide strength and wear resistance, the blade 11 should have an adequate height or thickness, indicated by the dimension h in FIG. 1. This dimension extends in the axial direction, as indicated by the arrow 13. In accordance with the prior art construction, the high point of the rear face 15 is disposed in proximity to the cup shaped recess 18 of the front face 17. Thus, the recess 18 tends to decrease the effective thickness or height of the blade. In accordance with the prior art constructions, it has been the practice to increase the distance h so as to offer sufficient strength and wear resistance. However, as the distance h is increased, the flow resistance of the blade 11 is increased and also there is an increased likelihood of cavitation. Although these problems can be reduced by shortening the thickness or hight h, such shortening with prior art constructions can weaken the blade or significantly reduce its life.

PREFERRED EMBODIMENT OF THE INVENTION

Figure 2:
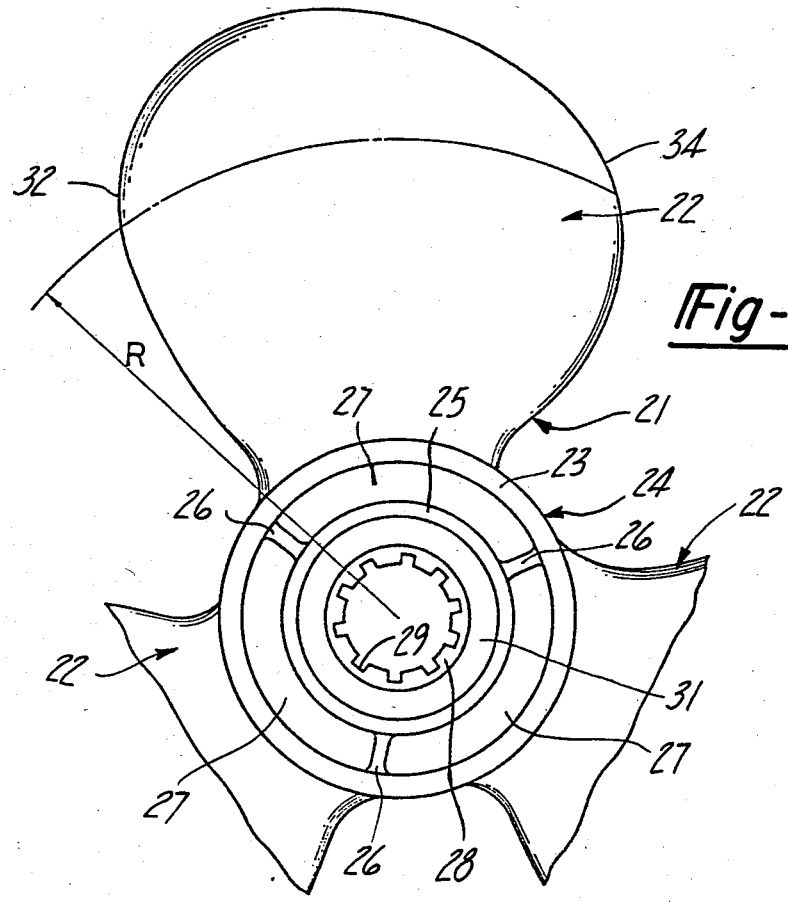
FIG. 2 is a partial, front elevational view of a marine propeller blade constructed in accordance with an embodiment of the invention.
Figure 3:
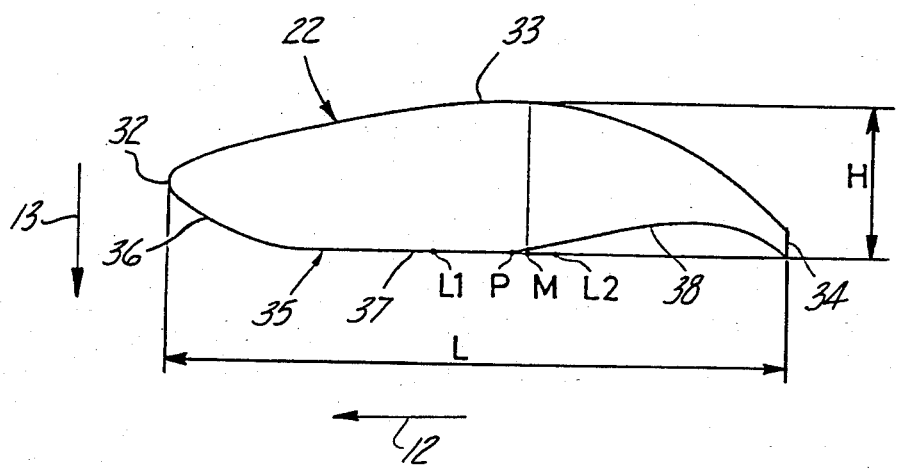
FIG. 3 is a developed cross-sectional view, in part similar to FIG. 1, showing the configuration of the blade of the embodiment of FIG. 2 taken along a radial plane at the distance R.

Referring now to FIGS. 2 and 3 and, initially, primarily to FIG. 2, a marine propeller having a blade configuration constructed in accordance with an embodiment of this invention is identified generally by the reference numeral 21. The propeller 21 includes a plurality of blades, each indicated generally by the reference numeral 22. In the illustrated embodiment, the propeller 21 has three such blades 22. It is to be understood, however, that the invention may be used in conjunction with propellers having different numbers of blades.

The blades 22 are integrally formed with an annular hub member 23 of a hub assembly, indicated generally by the reference numeral 24. The hub assembly 24 consists of the hub member 23 and an inner annular hub 25 that is spaced from the hub member 23 and connected to it by means of a plurality of radially extending, integral ribs 26. Openings 27 are formed between the ribs 26 and extend radially between the outer surface of the inner hub 25 and the inner surface of the hub member 23. The recesses 27 function as exhaust gas passages so that exhaust gases may be discharged through the hub of the propeller 21.

The hub assembly 24 also includes an inner hub member 28 that has an internally splined portion 29 so as to non-rotatably affix the propeller 21 to an associated drive shaft (not shown). The outer surface of the inner hub member 28 is spaced radially inwardly of the inner surface of the hub member 25 and an elastomeric cushioning member 31 is interposed between these two surfaces so as to affix the propeller blades 22 to the inner hub member 28 while at the same time affording some vibration damping.

The developed configuration of the blades 22 along a radial plane R is shown in detail in FIG. 3. In this figure, the direction of normal rotation is indicated by the arrow 12 and the direction of forward axial movement is indicated by the arrow 13.

The blade 21 has a leading edge 32 from which a rear face driving surface 33 extends. The surface 33 is curved and terminates at a trailing edge 34.

The blade 22 also has a front face, indicated generally by the reference numeral 35 that extends from the leading edge 32 to the trailing edge 34. The front face is made up of three interconnected sections comprising a wash back section 36 which extends from the leading edge 32 and which terminates at a generally planar section 37 that extends generally in the direction of rotation as indicated by the arrow 12. The planar section 37 merges continuously at a point P into a recessed cup shaped portion 38 which, in turn, terminates at the trailing edge 34. As with the prior art, the cup shaped portion 38 is configured so as to reduce the likelihood of cavitation at the rear face 33 and particularly at its trailing edge. The wash back surface 36 is provided in the area of the blade closest to the leading edge 32 and is designed so as to direct the water flow over the leading edge 32 of the blade at such a point so as to lie closer to the rear face 33 so as to further reduce the likelihood of cavitation and so as to improve the performance of the blade. It is to be understood, however, that the use of such a wash back surface 36 is not essential to the invention.

The developed length of the blade is identified by the dimension L and its maximum height or width is identified by the dimension H. The height H is the distance between the axial most rearward portion of the rear face 33 and the axialmost forward portion of the front face 35. In this embodiment, the axialmost portion of the front face 35 is the planar surface 37. The rearwardmost axial portion of the rear face 33 has a projection point M in the axial direction upon the front face 35 along the dimension H. This point M is positioned so that it will be substantially within the planar area 37 or very close to it, in accordance with the invention. In accordance with the invention, the point M lies somewhere within the range of the point $L_1$, which is at a distance approximately equal to 15% of the blade width L from the point P toward the leading edge 32 and a point $L_2$ which lies approximately 5% of the blade width L from the point P toward the trailing edge 34. As a result, the point M lies in an area where the front face 35 extends generally in an axial direction so that the blade thickness H may be maximized without increasing the overall thickness of the blade as in the prior art constructions, where the point M lies substantially within the recessed cup shaped area.

It should be readily apparent that the embodiment of the invention described permits the use of a relatively narrow yet high strength propeller blade which will improve anti-cavitation and efficiency, without sacrificing strength. This is achieved by providing the rearwardmost axial surface of the rear face in an area that is in line with the forwardmost axial surface of the front surface so as to achieve the maximum thickness without adding unnecessarily to the total thickness of the blade. Hence, the life of the blade and its stregth is achieved, while at the same time, affording good efficiency, low flow resistance and high anti-cavitation effects.

Although an embodiment of the invention has been illustrated and described, various changes and modifications may be made, without departing from the spirit and scope of the invention, as defined by the appended claims.

I claim:

1. A marine propeller blade having a leading edge and a trailing edge with a forward face and a rearward face each extending from said leading edge to said trailing edge, said forward face having a generally planar part extending from contiguous to said leading edge toward said trailing edge and merging into a generally recessed cup shaped part extending toward said trailing edge, said blade having its greatest thickness in the axial direction in an area contiguous to the point of merger of said planar part and said cup shaped part.

2. A marine propeller blade as set forth in claim 1 wherein the rearwardmost axial portion of the rearward face projected upon the front face lies in proximity to the point of merger of the planar part with the recessed cup shaped part.

3. A marine propeller blade as set forth in claim 2 wherein the point of projection lies within a range bounded by 15% of the width of the blade from the point of merger toward the leading edge and 5% of the length of the blade from the point of merger toward the trailing edge.

4. A marine propeller blade as set forth in claim 3 further including an inclined wash back part extending from the leading edge to the beginning of the planar part.

5. A marine propeller blade as set forth in claim 2 further including an inclined wash back part extending from the leading edge to the beginning of the planar part.

* * * * *